US006913661B2

(12) United States Patent
Fleming et al.

(10) Patent No.: US 6,913,661 B2
(45) Date of Patent: Jul. 5, 2005

(54) AMMONIUM NITRATE PROPELLANTS AND METHODS FOR PREPARING THE SAME

(75) Inventors: Wayne C. Fleming, Glendale, AZ (US); Hugh J. McSpadden, Glendale, AZ (US); Donald E. Olander, Tempe, AZ (US)

(73) Assignee: Universal Propulsion Company, Inc., Phoenix, AZ (US)

( * ) Notice: Subject to any disclaimer, the term of this patent is extended or adjusted under 35 U.S.C. 154(b) by 0 days.

(21) Appl. No.: 10/778,179

(22) Filed: Feb. 17, 2004

(65) Prior Publication Data

US 2005/0092406 A1 May 5, 2005

Related U.S. Application Data

(60) Division of application No. 10/013,446, filed on Dec. 13, 2001, now Pat. No. 6,726,788, which is a division of application No. 08/753,521, filed on Nov. 26, 1996, now Pat. No. 6,364,975, which is a continuation-in-part of application No. 08/183,711, filed on Jan. 19, 1994, now Pat. No. 5,583,315.

(51) Int. Cl.[7] ..... C06B 45/10; D03D 23/00

(52) U.S. Cl. ..... 149/19.92; 149/109.6

(58) Field of Search ..... 149/19.92, 109.6

(56) References Cited

U.S. PATENT DOCUMENTS

| | | | | |
|---|---|---|---|---|
| 2,730,814 A | | 1/1956 | Giacino | 34/9 |
| 2,879,133 A | | 3/1959 | Marti | 149/46 |
| 3,190,774 A | | 6/1965 | Wilson | 149/46 |
| 3,639,643 A | | 2/1972 | Mollerstedt et al. | 149/46 |
| 3,711,344 A | | 1/1973 | Pierce | 149/19 |
| 3,715,983 A | | 2/1973 | Rosinski | 241/1 |
| 3,720,553 A | | 3/1973 | Henderson | 149/47 |
| 3,770,524 A | * | 11/1973 | Walker et al. | 149/19.5 |
| 3,793,100 A | | 2/1974 | Fronabarger | 149/77 |
| 3,856,590 A | | 12/1974 | Kincaid et al. | 149/19.8 |
| 3,867,214 A | | 2/1975 | Zucker et al. | 149/100 |
| 3,912,561 A | * | 10/1975 | Doin et al. | 149/35 |
| 3,932,242 A | | 1/1976 | Bartley et al. | 149/19.9 |
| 3,954,528 A | | 5/1976 | Chang et al. | 149/19.4 |
| 3,956,890 A | | 5/1976 | Davis | 60/219 |
| 3,984,265 A | * | 10/1976 | Elrick et al. | 149/19.9 |
| 4,045,261 A | | 8/1977 | Baczuk | 149/19.8 |
| 4,061,511 A | | 12/1977 | Baczuk | 149/19.9 |
| 4,078,954 A | * | 3/1978 | Bernardy | 149/19.8 |
| 4,110,136 A | | 8/1978 | Hershkowitz et al. | 149/47 |
| 4,111,728 A | | 9/1978 | Ramnarace | 149/19.5 |
| 4,151,022 A | | 4/1979 | Donaghue et al. | 149/19.4 |
| 4,158,583 A | | 6/1979 | Frosch et al. | 149/19.4 |
| 4,196,026 A | | 4/1980 | Walker et al. | 149/46 |
| 4,214,928 A | | 7/1980 | Consaga | 149/19.9 |
| 4,234,363 A | | 11/1980 | Flanagan | 149/19.4 |
| 4,239,073 A | | 12/1980 | Reed, Jr. et al. | 149/19.9 |
| 4,241,661 A | * | 12/1980 | Elrick et al. | 102/290 |
| 4,248,644 A | | 2/1981 | Healy | 149/21 |
| 4,300,962 A | | 11/1981 | Stinecipher et al. | 149/47 |
| 4,353,758 A | | 10/1982 | Akst et al. | 149/109.6 |
| 4,388,126 A | | 6/1983 | Johnson et al. | 149/14 |
| 4,412,875 A | | 11/1983 | Hasegawa et al. | 149/19.9 |
| 4,472,214 A | | 9/1984 | Flanagan et al. | 149/19.6 |
| 4,481,048 A | | 11/1984 | Cady et al. | 149/47 |
| 4,486,396 A | | 12/1984 | Kjohl et al. | 423/265 |
| 4,547,234 A | | 10/1985 | Takeuchi et al. | 149/3 |
| 4,552,736 A | | 11/1985 | Mishra | 423/266 |
| 4,570,540 A | | 2/1986 | Bell | 102/202 |
| 4,591,399 A | | 5/1986 | van der Smissen et al. | 149/2 |
| 4,600,452 A | | 7/1986 | Jessop et al. | 149/19.3 |
| 4,678,524 A | | 7/1987 | Cranney et al. | 149/21 |
| 4,689,097 A | | 8/1987 | Jones | 149/21 |
| 4,701,227 A | | 10/1987 | Loverro et al. | 149/47 |
| 4,718,953 A | | 1/1988 | Nguyen et al. | 149/17 |
| 4,733,610 A | | 3/1988 | Lee et al. | 102/332 |
| 4,875,950 A | | 10/1989 | Waldock et al. | 149/21 |
| 4,878,968 A | | 11/1989 | Willer et al. | 149/45 |
| 4,938,813 A | | 7/1990 | Eisele et al. | 149/19.2 |
| 4,948,438 A | | 8/1990 | Patrick et al. | 149/38 |
| 4,994,123 A | | 2/1991 | Patrick et al. | 149/2 |

(Continued)

FOREIGN PATENT DOCUMENTS

| | | |
|---|---|---|
| RU | 1811520 A3 | 4/1993 |
| WO | WO95/04710 | 2/1995 |

OTHER PUBLICATIONS

NATO Standardization Agreement, Stanag 6016 (Edition 1 (1st Draft)). pp. 1–4 and A–1, B–1, B–2, C–1, C2, D–1, E–1, F–1, F–2 (Jun. 1996).

The Condensed Chemical Dictionary, 12th Ed., Van Nostrand Reinhold Co., p. 356 (1993).

Derwent Chemical Abstract No. XP–002140235 (Nov. 11, 1993).

Derwent Chemical Abstract No. XP–002140236 (Apr. 23, 1993).

Derwent Chemical Abstract No. XP–002140233, vol. 105, No. 24 (Dec. 15, 1986) and translation of same (Vovkotrub, V.A. et al, Modifying Transformations of Ammonium Nitrate Conditioned By Admixtures of Minerals, Khim. Tekhnol., No. 5, 13–18 (1986).

Derwent Chemical Abstract No. XP–002140234, vol. 104, No. 19 (May 12, 1986) and translation of same (Tsitsishvili, K.G. et al., Application of Natural Zeolites as Anticaking Agents for Mineral Fertilizers, Bull. Akad. Sci. Georgian SSR 120, No. 3, 537–539 (1985)).

*Primary Examiner*—Aileen Felton
(74) *Attorney, Agent, or Firm*—Jerry Holden

(57) ABSTRACT

The present invention is directed to an age-stabilized and/or strengthened ammonium nitrate propellant composition wherein the strengthening agent is selected from the group consisting of azodicarbonamide, dicyandiamide, oxamide and mixtures thereof and wherein the age-stabilizing agent is a molecular sieve having a pore size of 13 angstroms or less.

18 Claims, No Drawings

U.S. PATENT DOCUMENTS

| | | | | |
|---|---|---|---|---|
| 5,024,708 | A | 6/1991 | Gast et al. | 149/19.1 |
| 5,026,443 | A | 6/1991 | Muller et al. | 149/18 |
| 5,043,031 | A | 8/1991 | Redecker et al. | 149/19.1 |
| 5,062,365 | A | 11/1991 | Canterberry | 102/322 |
| 5,067,996 | A | 11/1991 | Lundstrom et al. | 149/19.4 |
| 5,074,938 | A | 12/1991 | Chi | 149/21 |
| 5,076,868 | A | 12/1991 | Doll et al. | 149/19.4 |
| 5,098,683 | A | 3/1992 | Mehrotra | 149/46 |
| 5,125,684 | A | 6/1992 | Cartwright | 280/736 |
| 5,151,138 | A | 9/1992 | Lownds | 149/21 |
| 5,198,046 | A | 3/1993 | Bucerius et al. | 149/61 |
| 5,271,778 | A | 12/1993 | Bradford et al. | 149/19.5 |
| 5,292,387 | A | 3/1994 | Highsmith et al. | 149/19.1 |
| 5,380,380 | A | 1/1995 | Poole et al. | 149/22 |
| 5,409,556 | A | 4/1995 | Lownds | 149/2 |
| 5,411,615 | A | 5/1995 | Sumrail et al. | 149/47 |
| 5,472,529 | A | 12/1995 | Arita et al. | 149/2 |
| 5,480,500 | A | 1/1996 | Richard et al. | 149/46 |
| 5,500,059 | A | 3/1996 | Lund et al. | 149/19.1 |
| 5,500,060 | A | 3/1996 | Holt et al. | 149/19.1 |
| 5,507,891 | A | 4/1996 | Zeigler | 149/47 |
| 5,520,756 | A | 5/1996 | Zeigler | 149/19.8 |
| 5,531,941 | A | 7/1996 | Poole | 149/109.6 |
| 5,552,000 | A | 9/1996 | Shepherd, Jr. | 149/2 |
| 5,554,820 | A | 9/1996 | Wardle et al. | 149/19.9 |
| 5,557,062 | A | 9/1996 | MacLaren et al. | 149/46 |
| 5,567,911 | A | 10/1996 | Ekman | 149/46 |
| 5,583,315 | A | 12/1996 | Fleming | 149/19.4 |
| 5,866,842 | A | 2/1999 | Wilson et al. | 149/46 |

* cited by examiner

AMMONIUM NITRATE PROPELLANTS AND METHODS FOR PREPARING THE SAME

CROSS-REFERENCE TO RELATED APPLICATIONS

This application is a divisional of U.S. patent application Ser. No. 10/013,446, filed Dec. 13, 2001, now U.S. Pat. No. 6,726,788, which is a divisional of U.S. patent application Ser. No. 08/753,521, filed Nov. 26, 1996, now U.S. Pat. No. 6,364,975, which is a continuation-in-part of U.S. patent application Ser. No. 08/183,711, filed Jan. 19, 1994, now U.S. Pat. No. 5,583,315, the entire disclosures of which are incorporated by reference herein.

FIELD OF THE INVENTION

The present invention is directed to ammonium nitrate propellant compositions. More particularly, it is directed to age-stabilized and/or strengthened ammonium nitrate propellant compositions and methods for making the same.

BACKGROUND OF THE INVENTION

Propellant compositions are useful for a variety applications. One such application is in vehicle air bag restraint devices. In such restraint devices, it is important to reduce the toxicity of gases produced upon combustion of the propellant. It is also desirable that the propellant composition burn in a smokeless or nearly smokeless fashion because the presence of smoke can cause various problems. For example, after an accident in which air bag has been deployed, smoke not only hinders visibility, it also interferes with any ongoing rescue efforts. Thus, it is desirable that propellant composition combustion products be smoke-free or nearly so.

Another application of propellant compositions is their use in rockets and in other munitions as propulsive propellant compositions. Combustion of propulsive propellant compositions in rockets and the like provides the energy required to transport them over long distances towards a given target. During battle, it is critical to maintain advantage of surprise and stealth. Therefore, it is desirable that rockets powered by propulsive propellant compositions be as undetectable as possible upon launch and during deployment.

To maintain the advantages of stealth and surprise, is important that the propellant composition be smoke-free nearly so during combustion. In an effort to meet the requirement of a smoke-free combustible propellant composition, several compositions have been developed by the U.S. military. Among the compositions developed are the "double base" propellant compositions. As is known in the art, "double base" refers to a propellant composition containing both nitroglycerine (NG) and nitrocellulose (NC). Double base propellants are prone to premature explosion or premature deflagration in response to various unplanned stimuli (e.g., fire, heat, shrapnel, bullets, other fragments, etc.) that may be encountered in battle. In addition, for propulsive applications, the energy output upon combustion of double base propellants is sometimes insufficient. Thus, the addition of energetic additives such as cyclotetramethylene tetranitramine (HMX) and/or cyclotrimethylene trinitramine (RDX) is often required to provide the energy output sought during combustion. However, the addition of such energetic additives exacerbates the already hazardous tendency of double base propellants to premature explosion or premature deflagration.

Nevertheless, to fulfill the smoke free energy requirements of propulsive propellants, as herein, propellant compositions propellants were pursued at the expense of safety, especially in regards to naval operations. Consequently, the U.S. Navy has taken the lead in formulating a series of standards concerning insensitive ammunition requirements, formalized as MIL-STD-2105B, incorporated herein by reference in its entirety. Equivalent insensitive ammunition standards have been adopted by most major military powers (e.g., England, France, Germany, etc.). These standards require that propellant compositions meet or exceed insensitive ammunition safety standards for the weapons platforms for which they were designed.

Further, with regards to military propulsive applications, various smoke characteristics required of propellant compositions have been strictly defined. Based on the empirical work performed by the U.S. Missile Command at Redstone Arsenal and some of their counterparts in other countries, industry accepted definitions of "minimum smoke" and "educed smoke" have been promulgated in STANAG 6016 (NATO Standardized Agreement Solid Propellant Smoke Classification). STANAG 6016 is incorporated herein by reference in its entirety. The smoke effluent is calculated by a number of thermo-chemical codes that are well known in the industry. For example, STANAG 6016 classifications "AA" and "AC" correspond to the definitions of minimum smoke and reduced smoke, respectively. The "smoke-free", "nearly smoke free," and/or "substantially smoke free" terms as used herein are synonymous with the definition of minimum smoke (i.e., code AA).

To meet these requirements (i.e., smoke free—minimum smoke in accordance with STANAG 6016; high energy output and safety—in accordance with Insensitive Ammunitions Requirements formalized as MIL-STD-2105B) attempts have been made to develop non-double base propellant compositions that are smoke free, yet safe for handling. For example, ammonium nitrate, metal nitrate, alkali earth metal nitrate, ammonium perchlorate and metal perchlorate propellant compositions and the like have been used. However, these propellant compositions present several problems. Metal nitrates, typically, produce solid particles upon combustion. These solid particles form a visible smoke referred to as "primary smoke" which is undesirable. Ammonium or metal perchlorates produce hydrogen chloride during combustion. Hydrogen chloride reacts with moisture in the ambient air to yield a liquid/gas aerosol. The aerosol forms another visible smoke referred to as "secondary smoke". Either "primary smoke" or "secondary smoke" formed as an effluent from the combustion of a propulsive propellant composition negates the advantage of surprise. The smoke trail aids opposing forces in destroying or otherwise countering the incoming missile. In addition, such effluent smoke points to the launch position. During battle, such smoke places launch personnel in greater danger of potentially successful retaliation, e.g., by counter battery fire.

Ammonium nitrate as a propellant ingredient may produce a propellant that does not produce primary or secondary smoke upon combustion. However, ammonium nitrate presents other drawbacks as a propellant component. Principally, it is recognized that ammonium nitrate undergoes several crystal phase changes at various well-recognized temperatures. Pure ammonium nitrate undergoes a series of structural and volumetric crystal phase transformations over typical operating temperature ranges. In pure ammonium nitrate, structural crystal phase transitions are observed at about −18° C., 32.3° C., 84.2° C. and 125.2° C., respectively. The phase transition at about 32.3° C. is particularly troublesome. A large volumetric change (about 3.7%) in the crystal phase of ammonium nitrate is observed when the temperature cycles above and below about 32.3° C. (i.e., transition between phase IV (below 32.3° C.) and phase III (above 32.3° C.)). As the ammonium nitrate cycles between phase IV and phase III, it expands and contracts. Repeated cycling through the phase IV to phase III transition temperature (i.e., about 32.3° C.) is associated with ammonium nitrate grain growth and destruction of grain integrity. The result is that there is porosity and loss in mechanical strength of ammonium nitrate based propellant compositions.

As used herein, the term "age-stabilized" refers to a state of ammonium nitrate wherein the crystal phase III–IV and volumetric changes associated with thermal cycling are substantially reduced. Thus, the shelf-life of an ammonium nitrate propellant composition is considerably increased from about 1–2 years to about 5–20 years or more.

Further, the term "strengthened", as used herein, refers to a state of ammonium nitrate propellant wherein the tensile strength of the propellant is increased without unduly sacrificing elongation or, alternatively, is accompanied by an increase in elongation. The strengthened ammonium nitrate propellant composition is substantially resistant to physical destruction of the propellant.

As also used herein, the term "safe" refers to an ammonium nitrate propellant composition that meets or exceeds the insensitive ammunition requirements promulgated in MIL-STD-2105B wherein the tendency to violent deflagration or explosion is substantially reduced and the shelf-life is substantially increased from about 1–2 years to about 5–20 years or more. Further, the term "safe" is used herein to refer to an ammonium nitrate propellant composition wherein the tendency to form grain fissures due to crystal phase changes is substantially reduced or altogether eliminated.

It is feared that non-strengthened/non-age-stabilized ammonium nitrate propellant compositions that have been stored (e.g., either in munitions or in vehicle air bag restraint devices) for more than about 1 to 2 years may have undergone several crystal phase changes to the extent that the physical integrity of the propellant has been compromised and the propellant will no longer perform in the desired manner. Consequently, the useful shelf-life of prior art ammonium nitrate propellant compositions is disadvantageously shortened. Thus, it is desirable to formulate a smoke-free (or substantially smoke free) yet safe ammonium nitrate propellant composition having an extended shelf-life.

Typically, a propulsive or gas generating device containing a propellant composition requires a shelf-life from about 5 to about 20 years or more. The shelf-life of the device is largely dependent on the shelf-life of the propellant composition contained therein. Typically, a desirable shelf-life for a munition (propulsive) propellant composition or a vehicle air bag (gas producing) propellant composition is about 5 or more years, preferably, from about 7 to 20 years. In order to obtain longer shelf-life ammonium nitrate propellant compositions, efforts have been directed at solving the crystal phase stabilization problem (i.e., of ammonium nitrate). For example, various patents and publications suggest the use of $KNO_3$, KF, metal dinitramide, or metal oxides such as MgO, NiO, CuO and/or ZnO as additives that yield phase stabilized ammonium nitrate. See, for example U.S. Pat. No. 4,158,583 to Anderson; U.S. Pat. No. 5,076,868 to Doll et al.; U.S. Pat. No. 5,271,778 to Bradford et al.; U.S. Pat. No. 5,292,387 to Highsmith et al; and U.S. Pat. No. 4,552,736 to Mishra; U.S. Pat. No. 5,545,272 to Poole et al. See also, Choi, C. S., and Prask, H. J., Phase Transitions in Ammonium Nitrate, J. Appl. Cryst., Vol. 13, pp. 403–409 (1980).

However, various problems are associated with the use of the aforementioned phase stabilizing additives. For example, the use of potassium nitrate leads to the formation of large amounts of undesirable residue as combustion products. See U.S. Pat. No. 4,552,736 to Mishra. When KF is used, it must be added to the molten phase (I) of ammonium nitrate. Thereafter, the KF modified ammonium nitrate is cooled. The requirement for melting ammonium nitrate before adding KF is cumbersome, expensive and time consuming. In addition, the effluent of a device using such a propellant is corrosive, smoky (with an enhanced radar cross section) and toxic.

The use of the metal oxides also has several drawbacks. For example, solid particulates are formed upon combustion when MgO, NiO, Cuo and/or ZnO are used. Solid particulates, as previously noted, contribute to the formation of primary smoke which is undesirable. Additionally, NiO is carcinogenic. Further, NiO and Cuo present environmental hazards. In addition, both NiO and ZnO are only marginally effective. That is, once exposed to moisture, these oxides are no longer effective ammonium nitrate phase stabilizers. Further, NiO and ZnO increase the detonatability of the ammonium nitrate which is undesirable. Additionally, manufacturing propellant compositions including NiO and/or ZnO is more expensive. Similarly, the use of metal dinitramides (see '387 to Highsmith et al.) also leads to the formation of primary smoke upon combustion. Thus, none of the known ammonium nitrate phase stabilizers are entirely satisfactory for forming a safe, age-stabilized and smoke-free ammonium nitrate propellant composition having a long shelf-life.

The occurrence of phase III in ammonium nitrate depends on the presence of water, e.g., down to as little as about 0.1% by weight of the ammonium nitrate. See Choi et al., J. Appl. Cryst., Vol. 13, p. 403 (1980). In particular, according to the '736 patent to Mishra, supra, (at column 2, lines 66–68), a high moisture content is said to favor III–IV phase transitions. Further, according to U.S. Pat. No. 4,486,396 to Kjohl et al., (at column 1, lines 30–32), these phase transitions render the ammonium nitrate less stable to thermal cycling.

U.S. Pat. No. 5,061,511 to Baczuk ('511) suggests the use of aluminum silicate molecular sieves (having a pore size of less than about 10 angstroms) as a stabilizer in propellant compositions such as single base or double base propellant. In particular, the '511 patent is directed to propellant compositions that give off gases during the aging process. These propellant compositions include nitrocellulose and nitroglycerin, high energy fluorine containing propellants, single or double base nitrate ester propellants and composite propellants such as ammonium perchlorate/Al with rubber binders. The undesirable gases given off by these propellants during aging include $N_2$, $CO_2$, CO, $NO_x$, and $F_2$. Likewise, U.S. Pat. No. 4,045,261 to Baczuk ('261) suggests the use of a molecular sieve (having a pore size of 10 angstroms or more) as part of a stabilization system for a urethane cross-linked double base propellant composition to scavenge nitric acid.

Since ammonium nitrate is not a propellant of the class described by Baczuk (i.e., See '511) and it does not give off the $N_2$, $CO_2$, CO, $NO_x$, or $F_2$ gases (i.e., see '511 ) during aging, there is no expectation that molecular sieves in general, much less those having a pore size of 10 angstroms or less would stabilize ammonium nitrate. Similarly, since ammonium nitrate is not a urethane cross-linked double base propellant (i.e., see '261), there is, likewise, no expectation that molecular sieves, e.g., having a pore size of 10 angstroms or more, would stabilize ammonium nitrate against volumetric crystal phase changes.

Nevertheless, since water is associated with the undesirable crystal phase changes of ammonium nitrate, Kjohl et al., supra, used porous additives which could absorb water to stabilize ammonium nitrate. They further discovered that the presence of water absorbing porous particles resulted in no movement of water in the ammonium nitrate particles and that, during thermal cycling, swelling of ammonium nitrate was observed only to a small extent. Kjohl et al., however, state that the porous particles should be added to the ammonium nitrate after the ammonium nitrate is dried. Finally, they state that not any type of porous particle is suitable for stabilizing ammonium nitrate. For example, according to Kjohl et al., silicates of the molecular sieve type can bind water, but it has been found difficult to give such particles the required particle size and binding to the ammonium nitrate particles. In effect, Kjohl et al. conclude that molecular sieves performed poorly in stabilizing ammonium nitrates (see column 3, lines 18–23).

Thus, there is still an existing need to provide a safe, age-stabilized and/or strengthened ammonium nitrate propellant composition having a long shelf-life that is substantially smoke free upon combustion as well as a method for making the same.

SUMMARY OF THE INVENTION

It is therefore an object of the present invention to provide a safe, age-stabilized, substantially smoke-free ammonium nitrate propellant composition that has a long shelf-life (e.g., up to about 20 years or more) and to provide a method of making the same.

It is another object of the present invention to provide a strengthened, substantially smoke-free ammonium nitrate propellant composition that has a long shelf-life and to provide a method for making the same.

It is a still further object of the present invention to provide a strengthened and age-stabilized, substantially smoke-free ammonium nitrate propellant composition that has a long shelf-life and to provide a method of making the same.

Surprisingly these and other objects are accomplished by the addition of silicates of the molecular sieve type to ammonium nitrate before grinding the ammonium nitrate present in the propellant composition. These objects are accomplished by an age-stabilized ammonium nitrate propellant composition comprising ammonium nitrate, a silicate molecular sieve and a binder. In addition, the process for forming a safe, age-stabilized ammonium nitrate propellant composition comprises the steps of providing a quantity of ammonium nitrate, adding a sufficient quantity of a silicate molecular sieve to absorb water from the ammonium nitrate, grinding the ammonium nitrate with the molecular sieve, maintaining contact between the ammonium nitrate and the sieve, then adding at least a binder (except any curing agent e.g., isocyanate curing agent), maintaining contact between the ground molecular sieve and the other ingredients and finally adding a curing agent, if any, to yield the safe, age-stabilized ammonium nitrate propellant composition having a long shelf-life.

Alternatively, these and other objects are accomplished by the addition of a strengthening agent to a mixture of ammonium nitrate and at least a binder to yield a strengthened propellant composition. Further, a molecular sieve may also be added to the strengthened ammonium nitrate propellant to yield an enhanced, strengthened and age-stabilized ammonium nitrate propellant composition.

Additionally, an age-stabilized ammonium nitrate composition may be formed by adding a molecular sieve to ammonium nitrate (e.g., at least about 1 gram of a molecular sieve per pound of ammonium nitrate) and then grinding the mixture. Thereafter, the mixture may be safely stored without deleterious changes for an extended period of time in a sealed container.

DETAILED DESCRIPTION OF THE PREFERRED EMBODIMENTS

The following detailed description is provided to aid those skilled in the art in practicing the present invention. However, it should not be construed to unduly limit the scope of the invention. Variations and modifications in the embodiments discussed may be made by those of ordinary skill in the art without departing from the invention According to the present invention, there are at least three embodiments of the ammonium nitrate propellant composition. The first embodiment of the present invention relates to an age-stabilized ammonium nitrate propellant composition. The second embodiment relates to a strengthened ammonium nitrate propellant composition. The third embodiment relates to an age-stabilized and strengthened ammonium nitrate propellant composition. Further, each embodiment may be used, with certain modifications, as a gas producing ammonium nitrate propellant composition or as a propulsive ammonium nitrate propellant composition. The gas producing ammonium nitrate propellant compositions are designed to be used in vehicle air bag restraint systems and the like wherein gas production is. paramount. The propulsive ammonium nitrate propellant compositions are designed to be used in rockets and other munitions wherein energy output is paramount.

In the first (i.e., age-stabilized) embodiment, the substantially smoke-free ammonium nitrate propellant composition comprises ammonium nitrate, a molecular sieve and a binder. Optionally, the first embodiment may contain one or more of a variety of additives. These additives include, but are not limited to, a nitroplasticizer (e.g., nitramines and/or nitrate esters which are in a liquid phase when added, typically, at room temperature such as at about 25° C.), an energetic additive (e.g., nitramines which are in a solid phase when added, typically, at room temperature), a nitrate ester stabilizer, a curing agent, a cure accelerator, an opacifier and a polymer protector (i.e., an antioxidant). In the first embodiment, the ammonium nitrate may be present as fines, prills, granules and the like. The size of the ammonium nitrate may vary between about 5 microns and about 5,000 microns (or any value there between) in thickness. However, a particle thickness is, preferably, from about 5 microns to about 400 microns and, most preferably, from about 30 to about 50 microns.

In the first embodiment, the amount of ammonium nitrate included is dependent upon the application for which the propellant composition is designed. For example, in propulsive applications, additives that increase the energy output (e.g., nitroplasticizers and/or energetic additives) of the first embodiment are preferably included therein. On the other hand, if designed for gas producing applications, such nitroplasticizers and/or energetic additives are often omitted from the first embodiment. However, nitroplasticizers and/or energetic additives may be optionally included therein. The amount of ammonium nitrate included in the first embodiment is varied depending upon the presence or absence of nitroplasticizers and/or energetic additives therein.

Unless otherwise specifically indicated, the percent by weight values of the various propellant components denoted below refer to a percent of the total weight of the propellant composition. In the first embodiment, when used for gas producing applications, the ammonium nitrate (when a nitroplasticizer and/or energetic additive is added) is present in an amount of at least about 60%. When nitroplasticizers and energetic additives are omitted from the first embodiment designed for gas producing applications, the amount of ammonium nitrate present may range from about 65% to about 85%.

However, for propulsive applications of the first embodiment, when combined with optional nitroplasticizers and/or energetic additives, the amount of ammonium nitrate added may range from about 40% to about 80% (or any value therebetween). In the absence of such nitroplasticizers and energetic additives, the amount of ammonium nitrate added to the first embodiment designed for propulsive applications ranges from about 65% to about 85%.

Further, as noted, the first embodiment of the invention contains a molecular sieve. One type of molecular sieve is an aluminosilicate type molecular sieve, commonly referred to as a zeolite molecular sieve. See, for example, Breck, D. W., Crystalline Molecular Sieves, Journal of Chemical Education, Vol. 41, p. 678 (December 1964). See UOP, Product Information Sheet, Union Carbide Molecular Sieves, Molecular Sieve Type 4A. See also, LINDE® Molecular Sieves Data, LINDE® Molecular Sieve Type 4A. See also, Cotton, F. A. and Wilkinson, G., Advanced Inorganic Chemistry-A Comprehensive Text, pp. 390–392, 4th Ed., John Wiley and Sons (New York 1980). Typical zeolites have the formula $Me_{x/n}((AlO_2)_x(SiO_2)_y).Z\ H_2O$ wherein Me=metal cation, and x, y and n are integers. Z is zero or a positive real number. Z indicates the number of waters of hydration associated with a given zeolite. Typically, y/x varies from about 1 to about 5. An exemplary type A synthetic zeolite has the formula $Na_{12}((AlO_2)_{12}(SiO_2)_{12}).27H_2O$. As noted by Cotton & Wilkinson, supra, a molecular sieve is obtained by heating a zeolite to about 350° C. under a vacuum to remove the water of hydration. Thus, once water is removed from a typical molecular sieve such as $Na_{12}((Al_{12}Si_{12}O_{48}).27H_2O$, a type A zeolite with anhydrous cubic microcrystals is formed.

For a particular molecular sieve to be appropriate for use in the first embodiment, it must have two properties. It must be a more active absorber of water than any other component (e.g., the ammonium nitrate, the binder etc.) of the ammonium nitrate propellant composition with the exception of the curing agent (i.e., in the presence of water, e.g., isocyanate curing agents typically react rapidly therewith). Further, the molecular sieve must retain the absorbed water molecules so that the water is not available to any other component of the ammonium nitrate propellant composition, especially the ammonium nitrate. Thus, the retention of the water in the molecular sieve/water adduct must be extremely robust.

In particular, without being bound by theory, it is believed that the water molecules must not be simply adsorbed onto the surface of the molecular sieve. It is believed that molecular sieves hold the water molecules within the pores present in the sieve. Further, without being bound by theory, it is believed that the water molecules may at first be adsorbed onto the surface of the molecular sieve. However, after a short period of time (e.g., up to about 48 hours), the water molecules are transported to the interior of the molecular sieve via its pores. Again without being bound by theory, it is believed that if the sieve has an adequate pore dimension (e.g., typically about 13 angstroms or less such as from about 3 to about 13 angstroms or any value therebetween), then the water can be absorbed into the interior of the sieve. Thus, the other components of the ammonium nitrate propellant composition (e.g., binders, nitroplasticizers, energetic additives, nitrate ester stabilizers, curing agents, cure catalysts, opacifiers and/or anti-oxidants) are sterically isolated from the absorbed water.

As noted, for the molecular sieve to successfully age-stabilize ammonium nitrate, it is required that the molecular sieve have a pore size sufficient to absorb and ultimately retain water. Thereby, the absorbed water becomes unavailable to the ammonium nitrate and the other components of the propellant composition. Typically, a pore size sufficient for this purpose is about 13 angstroms or less. Preferably, the pore size is from about 3 to about 13 angstroms or any value therebetween. More preferably, the pore size is from about 3 to about 5 angstroms. The most preferred pore size is about 4 angstroms. Examples of molecular sieves compatible with the first embodiment of the invention include, but are not limited to, molecular sieves type 3A, 4A, 5A and 13X, respectively. These sieves are made by various companies, including Union Carbide (N.Y., N.Y.) which sells its molecular sieves under the trademark LINDEN®. Molecular Sieve 4A is a sodium form of the type A crystal structure. It is an alkali metal alumino-silicate. The type 4A sieve will absorb molecules with critical diameters up to about 4 angstroms.

In the first embodiment of the propellant composition, the molecular sieve is present in an amount from about 0.02% to about 6% (or any value there between). Preferably, the molecular sieve is present from about 0.2% to about 0.4% and, most preferably, from about 0.20% to about 0.22%. The preferred molecular sieve is the type 4A sieve.

Binders compatible with the first embodiment of the present invention include, but are not limited to, thermoplastic elastomers (e.g., Finaprene™, Kraton™ or mixtures thereof) and a cure hardening material. Examples of cure hardening materials include, but are not limited to, a hydroxy terminated polybutadiene (HTPB), hydroxy terminated polyether (HTPE), polyglycol adipate (PGA), glycidylazide polymer (GAP), poly bis-3,3'-azidomethyl oxetane (BAMO), poly-3-nitratomethyl-3-methyl oxetane (PNMMO), polyethylene glycol (PEG), polypropylene glycol (PPG), cellulose acetate (CA) or mixtures thereof. An exemplary binder is a mixture of 7 parts by weight of BAMO and 3 parts by weight of PNMMO. However, the preferred binder is PGA. It is noted that other binders well-known in the art may be used.

Because nitroplasticizers are incompatible with HTPB (i.e., they are insoluble in one another), preferably, they are not combined in any of the embodiments of the propellant composition. When HTPB is the binder of choice, energetic additives (e.g., solid phase nitramines such as RDX, HMX) and/or other plasticizers such as dioctyl adipate (e.g., in an amount of about 3 to about 10% or any value therebetween) may be used. Other plasticizers compatible with HTPB are well known to those skilled in the art and may be used therewith.

The thermoplastic elastomeric binders compatible with the first, i.e., age-stabilized, embodiment of the present invention are those that have melting points or plasticized melting points above the expected use and storage temperatures of the propellant compositions. Typically, the use and storage temperatures range from about −65° F. to about 200° F. Further, the thermoplastic elastomers must melt in their plasticized state below the decomposition temperature of ammonium nitrate and/or any nitroplasticizer present therein. In the first embodiment, the binder is present from about 3% to about 40% (or any value therebetween), preferably, from about 5% to about 30%.

Further, as previously noted, the first embodiment may additionally contain an energetic additive (i.e., a solid phase component that increases energy output, e.g., some nitramines) and/or a nitroplasticizer (i.e., a liquid phase component that increases energy output, e.g., some nitrate esters and some nitramines). Typical nitroplasticizers compatible with the age-stabilized ammonium nitrate propellant composition (i.e., the first embodiment) of the present invention include, but are not limited to, trimethylol ethane trinitrate (TMETN), triethylene glycol dinitrate (TEGDN), triethylene glycol trinitrate (TEGTN), butanetriol trinitrate (BTTN), diethyleneglycol dinitrate (DEGDN), ethyleneglycol dinitrate (EGDN), nitroglycerine (NG), diethylene glycerin trinitrate (DEGTN), dinitroglycerine (DNG), nitrobenzene (NB), N-butyl-2- nitratoethylnitramine (BNEN), methyl-2-nitratoethylnitramine (MNEN), ethyl-2-nitratoethylnitramine (ENEN) or mixtures thereof. The preferred nitroplasticizer is a 50—50 by weight mixture of TMETN and TEGDN. In the first embodiment, the nitroplasticizer is optionally present up to about 40% by weight. Examples of energetic additives compatible with the first embodiment include, but are not limited to, dinitroxydiethylnitramine (DNDEN), cyclotrimethylene trinitramine (RDX), cyclotetramethylene tetranitramine (HMX) or mixtures thereof The preferred energetic additives are RDX, HMX or mixtures thereof. In the first embodiment, they are preferably present up to about 40%. As other similar nitroplasticizers and energetic additives become commercially available, they can be included in this list as one of ordinary skill in the art would recognize.

Because nitroplasticizers and energetic additives tend to increase the energy output, flame temperature and explosive nature of an ammonium nitrate propellant composition, these materials are not always included within the first embodiment of the invention when used for gas producing applications, rather they may be optionally included therein. In the gas producing applications, the nitroplasticizer and/or energetic additive may be present (i.e., as an optional additive) in an amount of up to about 35%. Conversely, it is desirable to use nitroplasticizers and/or energetic additives in the propulsive applications of the first embodiment wherein increased energy output is paramount. In the propulsive munitions applications, the nitroplasticizer and/or energetic additive is typically present in an amount from about 5% to about 40% or any value therebetween. The amounts of the binder plus any nitroplasticizer and energetic additive must total at least about 20% to form a physically acceptable first embodiment and, preferably, from about 20% to about 35%. As used herein "physically acceptable" means a composition that can be formed into various desirable shapes, (e.g., grains, etc.) and which can be maintained in those shapes.

When a nitroplasticizer which is a nitrate ester is included in the first embodiment, it is preferred that a nitrate ester stabilizer be added as well. When a nitroplasticizer is not used or when an energetic additive (e.g., a nitramine such as RDX, HMX or mixtures thereof), without a nitroplasticizer, is included in the propellant composition, the nitrate ester stabilizer may be omitted from the propellant composition. Thus, in the first embodiment according to the present invention, the nitrate ester stabilizer may be present in an amount of up to about 3%, more preferably, from about 0.1% to about 2% and, most preferably, from about 0.35% to about 0.5%. Nitrate ester stabilizers compatible with the first embodiment of the present invention include, but are not limited to, N-methyl-4-nitroaniline (MNA), 2-nitrodiphenylamine (NDA), ethyl centralite (EC) or mixtures thereof. The preferred nitrate ester stabilizer is a mixture of MNA and NDA, preferably, in a weight ratio of about 1:1.

Curing agents compatible with the first embodiment of the present invention include, but are not limited to, hexamethylene diisocyanate (HDMI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylylene diisocyanate (MXDI), other diisocyanates, triisocyanates, higher isocyanates than the triisocyanates, polyfunctional isocyanates (e.g., Desmodur N 100), other polyfunctional isocyanates or mixtures thereof. It is preferred that the isocyanate have at least two reactive isocyanate groups. If there are no binder ingredients with a functionality that is greater than 2, then the curative functionality (e.g., number of reactive isocyanate groups per molecule of isocyanate curing agent) must be greater than 2.0. The amount of the curing agent is determined by the desired stoichiometry (i.e., stoichiometry between curable binder and curing agent). The curing agent is present in an amount of up to about 5%. However, if a curable binder (e.g., binder having reactive hydroxyl groups such as HTPB) is used, the curing agent is present from about 0.5% to about 5%.

When a curing agent is used, a cure catalyst is preferably added to the propellant composition. The cure catalyst is used to accelerate the curing reaction between the curable binder and the curing agent. Cure catalysts compatible with the first embodiment of the present invention include, but are not limited to, a tin dilaurate (e.g., an alkyl tin dilaurate, butyl tin dilaurate, isopropyl tin dilaurate etc.), metal acetylacetonate, triphenyl bismuth, maleic anhydride, magnesium oxide or mixtures thereof A preferred cure catalyst is an equal % by weight mixture (i.e., 33⅓%) of each of triphenyl bismuth, maleic anhydride and magnesium oxide. The cure catalyst is present up to about 0.3% by weight. Further, one opacifier which is compatible with the first embodiment is carbon black. The opacifier is present up to about 2%. Those skilled in the art are aware of other opacifiers that may be used.

Antioxidants may also be added to the first embodiment of the present invention. Antioxidants compatible with the first embodiment of the present invention include, but are not limited to, 2,2'-bis(4-methyl-6-tert-butylphenol), 4,4'-bis (4-methyl-6-tert-butylphenol) or mixtures thereof other antioxidants well known in the art are within the scope of the present invention. The antioxidant is present in an amount of up to about 1%.

Turning now to an alternate embodiment (i.e., the second embodiment, also referred to as the strengthened embodiment) of the invention, the propellant composition comprises ammonium nitrate, a strengthening agent and a binder. The ammonium nitrate component included in this embodiment is the same as that previously described with respect to the first embodiment.

Preferred strengthening agents compatible with the second embodiment of the present invention include, but are not limited to, azodicarbonamide, dicyandiamide, oxamide or mixtures thereof. The most preferred strengthening agent is azidocarbonamide. In the second embodiment of the present propellant composition, the strengthening agent is present in an amount from about 2% to about 20%. Preferably, the strengthening agent is present from about 3% to about 12% and, most preferably, from about 8% to about 12%.

Optional additives compatible with the second embodiment include, but are not limited to, a curing agent, a cure accelerator, a nitroplasticizer, an energetic additive, a nitrate ester stabilizer, an opacifier, and/or an antioxidant. The binders, nitroplasticizers, energetic additives, nitrate ester stabilizers, curing agents, cure catalysts, opacifiers and/or anti-oxidants compatible with the first embodiment are equally compatible with the second embodiment. Further, the amounts of ammonium nitrate, nitroplasticizer, energetic additive, nitrate ester stabilizer, curing agent, cure catalyst, opacifier and/or anti-oxidant described with respect to the first embodiment are equally applicable to the second embodiment.

The binder included in the second embodiment is present in an amount from about 3% to about 40% or any value there between. The binder is preferably present in the subject embodiment in an amount from about 3% to about 20%. Further, in the second embodiment, the binder plus any nitroplasticizer and energetic additive must total at least about 20% to form a physically acceptable second embodiment and, preferably, from about 20% to about 35%. It should be noted that the second embodiment does not contain a molecular sieve.

The addition of a strengthening agent to a propellant composition reduces its impulse. To compensate for the loss of impulse, nitroplasticizers and/or energetic additives are added. Typically, ammonium nitrate propellant compositions lose their detonatable characteristic when the impulse is less than or equal to about 229 $lb._{force}$–seconds/$lb._{mass}$. However, if a sufficient amount of one or more nitroplasticizers and/or energetic additives is added to an ammonium nitrate propellant composition containing a strengthening agent, then the advantages of the strengthening agent are obtained without loss of impulse. The effect of adding a strengthening agent to the following ammonium nitrate propellant compositions (Table I) yielded the results (Table II) indicated below:

TABLE I

| Propellant Composition | Sample 1 | Sample 2 | Sample 3 | (Control) Sample 4 |
|---|---|---|---|---|
| Polyglycol Adipate | 6.23% | 6.230 | 6.23% | 6.23% |
| TMETN | 11.00% | 11.00% | 11.00% | 11.00% |
| TEGDN | 11.00% | 11.00% | 11.00% | 11.00% |
| Multifunctional Isocyanate (Desmodur N-100) | 1.3% | 1.3% | 1.3% | 1.3% |
| MNA (nitroplasticizer-stabilizer) | 0.5% | 0.5% | 0.5% | 0.5% |
| Carbon Black | 0.1% | 0.1% | 0.1% | 0.1% |
| Ammonium Nitrate (30 to 50 microns average thickness) | 54.87% | 59.87% | 64.87% | 69.87% |
| Strengthening Agent (azodicarbonamide) | 15.00% | 10.00% | 5.00% | 0.0% |

As previously noted, unless indicated otherwise, all components are indicated as a percent by weight of the total weight of the propellant composition. Further, all components of the propellant composition add to a total of 100% by weight.

TABLE II

| | Temperature ° F. | Maximum stress (psi) | % Elongation |
|---|---|---|---|
| (Sample 1) | 165 | 136 | 27 |
| | 75 | 203 | 34 |
| | −40 | 660 | 43 |
| (Sample 2) | 165 | 135 | 18 |
| | 75 | 189 | 24 |
| | −40 | 422 | 32 |
| (Sample 3) | 165 | 116 | 17 |
| | 75 | 182 | 22 |
| | −40 | 407 | 31 |
| (Control) | 165 | 101 | 18 |
| (Sample 4) | 75 | 173 | 23 |
| | −40 | 237 | 22 |

As shown in Table II, as the percentage of strengthening agent is increased to 15%, both the maximum stress and percent elongation are increased from the control values. Increased maximum stress and percent elongation indicate a tougher propellant composition more resistant to premature deflagration or explosion from unplanned stimuli such as impact with multiple fragments, e.g., bullets and the like. The maximum stress and elongation measurements were made according to test procedures described in Chemical Propulsion Information Agency (CPIA) Publication 21, Section 4.3.2 (Supplement) using a class C specimen. CPIA Publication 21 is incorporated herein by reference in its entirety.

Now referring to the third embodiment of the invention, (i.e., an age-stabilized/strengthened propellant composition), this embodiment comprises ammonium nitrate, a molecular sieve, a strengthening agent and a binder. The same ammonium nitrates, molecular sieves, strengthening agents, binders, nitroplasticizers, energetic additives, nitrate ester stabilizers, curing agents, cure catalysts, opacifiers and/or anti-oxidants compatible with the first and/or second embodiments are equally compatible with the third embodiment. Further, unless indicated otherwise below, the amounts of ammonium nitrate, nitroplasticizer, energetic additive, nitrate ester stabilizer, curing agent, cure catalyst, opacifier and/or anti-oxidant described with respect to the first and/or second embodiments are equally applicable to the third embodiment. It should be noted that the third embodiment contains both a molecular sieve and a strengthening agent in accordance with the first and second embodiments, respectively. The amounts of strengthening agent added to the second embodiment are equally applicable to this third embodiment. Likewise, the amounts of the molecular sieve added to the first embodiment are equally applicable to the third embodiment. Lastly, in the third embodiment, the binder is present in an amount from about 5% to about 30%. The binder plus any nitroplasticizer and energetic additive must total at least about 20% to form a physically acceptable third embodiment and, preferably, from about 20% to about 35%.

Hereinafter, methods for forming the various embodiments of the composition of the present invention are described in detail. Initial drying of all components is accomplished according to typical industry practices, which are well known in the art. For example, the ammonium nitrate is dried (e.g., in an oven) at approximately 110° C. for about 16 hours to remove surface water. Appropriate initial drying methods for all the propellant components are well known to those skilled in the art. As previously indicated herein and as indicated immediately below, for embodiments containing a molecular sieve (e.g., the first and third embodiments), significant additional drying is accomplished with the molecular sieve.

Before the other components of the propellant composition are added, at least a portion of the molecular sieve to be ultimately added is mixed with the ammonium nitrate. For example, after initial drying, the molecular sieve is added to the extent of at least about 1 gram per pound of ammonium nitrate. Then the mixture of the ammonium nitrate and the molecular sieve maybe allowed to stand for a first aging period. The first aging period is up to about 48 hours or longer, preferably, from about 0.25 hour to about 16 hours and, most preferably, as close to zero as possible.

If the mixture of the molecular sieve and the ammonium nitrate is exposed to the ambient air (i.e., including the moisture therein), it is preferably ground immediately after mixing (i.e., the first aging period is zero minutes or nearly so). If, however-, the mixture is held in a sealed container (i.e., with limited exposure to ambient air and the moisture therein), then the mixture may be maintained indefinitely without grinding. For example, the first aging period may be up to about 48 hours (or more) such as from about 4 to about 16 hours. However, it is preferred to grind the mixture immediately (or, for example, as soon as it is practical to do so on a production or assembly line) after mixing to yield a first mixture. Though not bound by theory, it is believed that grinding (the mixture) allows the molecular sieve to be in closer physical proximity to the ammonium nitrate and the water associated with it. Thereby, it is further believed that grinding allows the molecular sieve to more effectively and efficiently absorb (and retain) water away from the ground ammonium nitrate.

Grinding is accomplished by ball milling, fluid energy milling or micropulverizing. Other grinding methods well known in the art may also be used. Further, so long as it is compatible as feed stock for the particular grinding method to be used, the particle characteristics (e.g., particle thickness, particle size, particulate form-grains, prills, crystals size etc.) of the ammonium nitrate are not critical. The size of the ammonium nitrate should be, as previously noted, from about 5 microns to about 400 microns, preferably, from about 30 microns to about 50 microns in thickness.

After both grinding then aging (or just grinding if first aging period=zero hours), the remaining components of the propellant composition (except for any curing agent) are added to the first mixture to yield a second mixture. Thereafter, the second mixture is allowed to stand for a second aging period.

The second aging period allows the molecular sieve to absorb (and retain) a sufficient amount of the water present to age-stabilize the second mixture. The second aging period is up to about 48 hours or longer, preferably, from about 0.25 hour to about 24 hours and, most preferably, from about 16 to about 24 hours. Lastly, the curing agent, if any, (e.g., isocyanate curing agent) is optionally added to the second mixture to complete and form the final age-stabilized ammonium nitrate propellant composition or the final age-stabilized/strengthened propellant composition.

The propellant composition of Example 8, infra, was prepared wherein the first aging period was set to zero hours and the second aging period was set to zero, 2 hours and 48 hours, respectively. The effect of varying the second aging period on hardness (Shore A), ultimate tensile strength (psi) and elongation at break (%) for the propellant composition of Example 8, infra, is given in Table III below.

TABLE III

EFFECT OF VARYING THE SECOND AGING PERIOD FOR THE PROPELLANT COMPOSITION OF EXAMPLE 8, infra.

| Second Aging Period (Hours) | 0 (Control) | 2 | 48 |
|---|---|---|---|
| Hardness (Shore A) | nil | 73 | 74 |
| Ultimate Tensile Strength (psi) | nil | 117 | 169 |
| Elongation at maximum stress (%) | nil | 21 | 28 |

Elongation is an indication of elasticity. It indicates the length through which the propellant composition can be stretched before it breaks. An increase in tensile strength with a concurrent increase in elongation indicates an increase in "toughness", The increase in "toughness" indicates that less damage will occur in bullet or fragment impact scenarios. Less damage means less surface area to burn and therefore the reaction to unplanned stimuli (e.g., bullet or fragment impact) will be less violent. The aging periods significantly increase the shelf-life (e.g., to 20 years or more) of the ammonium nitrate propellant composition.

For those propellant compositions not containing a molecular sieve, but including a strengthening agent (e.g., the second embodiment), the ammonium nitrate is ground by ball milling, fluid energy milling or micropulverizing. Other grinding methods well known in the art may also be used. Thereafter, the ground ammonium nitrate is mixed with the remainder of the other components of the propellant composition, including the strengthening agent. As noted, an increase in the elasticity and the maximum stress of a propellant composition indicates that the propellant composition is less prone to cracking, etc., and less prone to violent deflagration or explosion.

Having described the invention, the following examples are provided to illustrate specific applications thereof, including the best mode now known to perform the invention. These specific examples are not intended to limit the scope of the invention described herein.

EXAMPLES

The following propellant compositions were prepared using the components in the quantities indicated below. However, where indicated the examples are prophetic. It should be noted that in all the prophetic examples, a nitrate ester plasticizer and a cure catalyst are included where appropriate as previously explained. Further, all components in each formulation add up to a total of 100% by weight. Prophetic examples 9, 10, 11 and 12 indicate age-stabilized and mildly strengthened propellant compositions with a slight loss in propellant composition impulse. Prophetic examples 13, 14, 15 and 16 indicate age-stabilized and moderately strengthened propellant compositions with a moderate loss in propellant composition impulse. Prophetic examples 17, 18, 19 and 20 indicate age-stabilized and strongly strengthened propellant compositions with a significant loss in propellant composition impulse. Other minor components that may be included in all prophetic examples include opacifiers, nitrate ester stabilizers, anti-oxidants and cure catalysts. These minor ingredients enhance age-stabilization, ballistic uniformity, accelerate curing and the like well known in the art.

| Chemical Component | Relative Percentage by Weight |
|---|---|
| Example 1 (Age-Stabilized) | |
| Polyglycol Adipate | 6.12 |
| Trimethylolethane Trinitrate | 11.00 |
| Triethyleneglycol Dinitrate | 11.00 |
| N-Methyl-4-Nitroaniline | 0.37 |
| Trifunctional Isocyanate | 1.32 |
| Carbon Black | 2.00 |
| Ammonium Nitrate | 67.97 |
| Molecular Sieve 4A | 0.22 |
| Example 2 (Age-Stabilized) | |
| Dioctyl Adipate | 6.60 |
| Carbon Black | 2.00 |
| Isophorone Diisocyanate | 1.30 |
| Ammonium Nitrate | 75.80 |
| Molecular Sieve 4A | 0.22 |
| Hydroxyterminated Polybutadiene | 14.10 |
| Prophetic Example 3 (Age-Stabilized) | |
| Dioctyl Adipate | 2–6% |
| Carbon black | 0.05–0.4% |
| Hydroxyterminated Polybutadiene | 9–14% |
| Isophorone Diisocyanate | 1–3% |
| Molecular Sieve 3A, 4A, 5A, 13X or mixtures thereof | 0.2–0.4% |
| Ammonium Nitrate | 70–85% |
| Prophetic Example 4 (Age-Stabilized) | |
| Dioctyl Adipate | 2–6% |
| Carbon Black | 0.05–0.4% |
| Hydroxyterminated Polyether | 9–14% |
| Isophorone Diisocyanate | 1–3% |
| Molecular Sieve 3A, 4A, 5A, 13X or mixtures thereof | 0.2–0.4% |
| Ammonium Nitrate | 70–85% |
| Prophetic Example 5 (Age-Stabilized) | |
| Polyglycol Adipate | 5–8% |
| Nitroplasticizers | 20–24% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 65–75% |
| Prophetic Example 6 (Age-Stabilized) | |
| Hydroxyterminated Polyether | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 65–74% |
| Example 7 (Age-Stabilized & Strengthened) | |
| Polyglycol Adipate | 6.12 |
| Trimethylolethane Trinitrate | 11.00 |
| Carbon Black | 2.00 |
| Triethyleneglycol Dinitrate | 11.00 |
| N-Methyl-4-Nitroaniline | 0.37 |
| Ammonium Nitrate | 63.97 |
| Trifunctional Isocyanate | 1.32 |
| Molecular Sieve 4A | 0.22 |
| Dicyandiamide | 4.00 |

A first mixture was prepared according to Example 21, infra. All components (except the curing agent) in the amounts, as indicated immediately above, were combined in a propellant mixer and mixed for 15 minutes without vacuum. The mixing was then stopped and the mixture held at 140° F. for 18 hours with the mix bucket sealed. Then the curing agent was added and then mixed therein under vacuum for 15 minutes. The mixer was then scraped down and the propellant mixed under vacuum for another 15 minutes. This mixture was then pressure cast into a block mold or into motors. The propellant composition was then cured within 48 hours at 140° F.

The addition of 4% dicyandimaide to the above propellant composition more than doubled the tensile strength and also significantly increased the strain capability (i.e., the elongation) thereof.

| Chemical Component | Relative percentage By Weight |
|---|---|
| Example 8 (Age-Stabilized) | |
| Polyglycol Adipate | 6.12 |
| Trimethylolethane Trinitrate | 11.00 |
| Carbon Black | 2.00 |
| Triethyleneglycol Dinitrate | 11.00 |
| N-Methyl-4-Nitroaniline | 0.37 |
| Ammonium Nitrate | 67.97 |
| Trifunctional Isocyanate | 1.32 |
| Molecular Sieve 4A | 4.00 |
| Prophetic Example 9 (Age-Stabilized & Mildly Strengthened) | |
| Hydroxyterminated Polyether | 5–8% |
| Nitroplaslicizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 68–71% |
| Azodicarbonamide | 3–8% |
| Example 10 (Age-Stabilized & Mildly Strengthened) | |
| Polyglycol Adipate | 5–85 |
| Nitroplasticizers | 20–24% |
| Trifunctional Isocyanate | 1–3% |
| Carbon Black | 0.05–0.44% |
| Molecular Si3ve 3A, 4A, 5A, 13X or mixtures thereof | 0.2–0.4% |
| Ammonium Nitrate | 68.71% |
| Dicyandiamide | 3–8% |
| Prophetic Example 11 (Age-Stabilized & Mildly Strengthened) | |
| Hydroxyterminated Polyether | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X Or mixtures thereof | 0.2–0.4% |
| Ammonium Nitrate | 68–71% |
| Azodicarbonamide | 3–8% |
| Prophetic Example 12 (Age-Stabilized & Mildly Strengthened) | |
| Polyglycol Adipate | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 68–71% |
| Azodicarbonamide | 3–8% |
| Prophetic Example 13 (Age-Stabilized & Moderately Strengthened) | |
| Hydroxyterminated Polyether | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 65–70% |
| Azodicarbonamide | 8–12% |

| Chemical Component Relative | Percentage By Weight |
|---|---|
| Prophetic Example 14 (Age-Stabilized & Moderately Strengthened) | |
| Polyglycol Adipate | 5–8% |
| Nitroplasticizers | 20–25% |
| Trifunctional Isocyanate | 1–3% |

-continued

| | |
|---|---|
| Carbon Black | 0.05–0.4% |
| Molecular Sieve 3A, 4A, 5A, 13X or mixtures thereof | 0.2–0.4% |
| Ammonium Nitrate | 65–70% |
| Dicyandiamide | 8–12% |

| Chemical Component | Relative Percentage By Weight |
|---|---|
| Prophetic Example 15 (Age-Stabilized & Moderately Strengthened) | |
| Hydroxyterminated Polyether | 5–8% |
| Nitroplasticizers | 20–25% |
| Trifunctional Isocyanate | 1–3% |
| Carbon Black | 0.05–0.04% |
| Molecular Sieve 3A, 4A, 5A, 13X or mixtures thereof | 0.2–0.4% |
| Ammonium Nitrate | 65–70% |
| Dicyandiamide | 8–12% |
| Prophetic Example 16 (Age-Stabilized & Moderately Strengthened) | |
| Polyglycol Adipate | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 65–70% |
| Azodicarbonamide | 8–12% |
| Prophetic Example 17 (Age-Stabilized & Strongly Strengthened) | |
| Hydroxyterminated Polyether | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 54–65% |
| Azodicarbonamide | 12–16% |
| Prophetic Example 18 (Age-Stabilized & Strongly Strengthened) | |
| Polyglycol Adipate | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 54–65% |
| Dicyandiamide | 12–16% |
| Prophetic Example 19 (Age-Stabilized & Strongly Strengthened) | |
| Hydroxyterminated Polyether | 5–8% |
| Nitroplasticizers | 20–25% |
| Trifunctional Isocyanate | 1–3% |
| Carbon Black | 0.05–0.4% |
| Molecular Sieve 3A, 4A, 5A, 13X or mixtures thereof | 0.2–0.4% |
| Ammonium Nitrate | 54–65% |
| Dicyandiamide | 12–16% |
| Prophetic Example 20 (Age-Stabilized & Strongly Strengthened) | |
| Polyglycol Adipate | 5–8% |
| Nitroplasticizers | 20–25% |
| Trifunctional Isocyanate | 1–3% |
| Carbon Black | 0.05-0.4% 25 |
| Molecular Sieve 3A, 4A, 5A, 13X or mixtures thereof | 0.2–0.4% |
| Ammonium Nitrate | 54–65% |
| Azodicarbonamide | 12–16% |

Example 21

First Mixture

One pound of ammonium nitrate (AN) was dried at 230° F. for 16 hours. One gram of 3A molecular sieve was added and the mixture ground in a ball mill for 10 minutes. This produced a first mixture of AN with an average particle size of about 50 microns. The first mixture is best used immediately, but can be stored in a sealed container for at least about one year.

Example 22

Composition 7019-A with No Age-stabilization

Cellulose acetate (4.0 grams) was dissolved in 25 ml of acetone. AN was ground according to Example 21 without molecular sieve being added. Ground AN (60 grams) and RDX (36 grams) were dry blended by tumbling in a mix bucket. The mixed dry material was then added to the cellulose acetate/acetone solution and hand stirred. Acetone was added as necessary to form a thick paste. The paste was then formed into sheets or extruded into strands or made into granules by screening while still damp. In the preferred form, 7019-A was formed into sheets about 0.030 inches thick, then dried in a vacuum oven at 140° F. The sheets were then broken into smaller pieces and then screened through a 5 mesh screen

Example 23

Composition 7019-A with Age-stabilization

The procedure followed was the same as Example 22 except that the AN was ground with molecular sieve according to Example 21.

Example 24

Strengthened Propellant Composition

The same procedure as in Example 7 was followed except that the molecular sieve was omitted from the composition. The amount of binder was increased by 0.22% by weight. otherwise the procedure followed was identical to Example 7.

Example 25

Age Stabilized Composition

The same procedure as in Example 7 was followed except that the strengthening agent was omitted from the composition. The amount of binder was increased by 4.0% by weight. Otherwise the procedure followed was identical to Example 7.

Prophetic Example 26

Hi-Temp/AN Composition with Age-stabilization

Mix Hi-Temp® (100 grams) and a first mixture (100 grams-made according to Example 21) by tumbling in a mixing bucket. Then add just enough acetone to wet the particles and cause the ingredients to stick together. Dry the mixture at 1 40° F. under vacuum. Screen through a 5 mesh screen and store sealed in a sealed container.

What is claimed is:

1. A process of forming a strengthened propellant composition comprising the steps of:

grinding ammonium nitrate; and forming a mixture comprising:

ground ammonium nitrate in an amount from about 40 percent to about 85 percent by weight of the composition;

azidocarbonamide in an amount from about 8 percent to about 12 percent by weight of the composition;

polyglycol adipate; and an additional component selected from the group consisting of trimethylol ethane trinitrate, triethylene glycol dinitrate, triethylene glycol trinitrate, butanetriol trinitrate, diethyleneglycol dinitrate, ethyleneglycol dinitrate, nitroglycerine, diethylene glycerin trinitrate, dinitroglycerine, nitrobenzene, N-butyl-2-nitratoethylnitramine, methyl-2-nitratoethylnitramine, ethyl-2-nitratoethylnitramine, cyclotrimethylene trinitramine, cyclotetramethylene tetranitramine, dinitroxyethylnitramine, and mixtures thereof.

2. The process of claim 1, wherein the polyglycol adipate is provided in an amount from about 3 percent to about 20 percent by weight of the composition.

3. The process of claim 1, wherein the additional component is selected from the group consisting of trimethylol ethane trinitrate, triethylene glycol dinitrate, cyclotrimethylene trinitramine, cyclotetramethylene tetranitramine, and mixtures thereof.

4. The process of claim 3, wherein the combined amount of the polyglycol adipate and the additional component is from about 20 percent to about 35 percent of the composition.

5. The process of claim 1, wherein the composition is substantially smoke-free upon combustion.

6. The process of claim 1, wherein the step of grinding ammonium nitrate comprises the steps of:

mixing ammonium nitrate and a synthetic zeolite to form a first mixture, wherein the synthetic zeolite is provided in an amount from about 0.2 percent to about 6 percent by weight of the composition; and grinding the first mixture.

7. The process of claim 1, wherein the ammonium nitrate is provided in an amount from about 40 percent to about 80 percent by weight of the composition.

8. A process of forming an age-stabilized, strengthened propellant composition comprising the steps of:

forming a primary mixture of ammonium nitrate and a molecular sieve, wherein the molecular sieve is present in an amount from about 0.2 percent to about 6 percent by weight of the composition;

aging the primary mixture for a first aging period;

forming a secondary mixture by adding a strengthening agent and a binder to the primary mixture, wherein the amount of binder is sufficient to form the secondary mixture into a desired shape; and aging the secondary mixture for a second aging period.

9. The process of claim 8, wherein the step of forming the primary mixture comprises mixing and grinding the ammonium nitrate and the molecular sieve.

10. The process of claim 8, wherein the molecular sieve is a synthetic zeolite having a pore size from about 3 angstroms to about 5 angstroms.

11. The process of claim 8, wherein the first and second aging periods are less than about 48 hours.

12. The process of claim 8, wherein the binder is present in an amount from about 3 percent to 40 percent by weight of the composition.

13. The process of claim 8, wherein the binder is present in an amount from about 5 percent to 30 percent by weight of the composition.

14. The process of claim 8, further comprising the step of grinding the ammonium nitrate prior to forming the primary mixture.

15. The process of claim 14, wherein the step of grinding comprises ball milling, fluid energy milling, or micropulverizing.

16. The process of claim 8, wherein the binder is selected from the group consisting of thermoplastic elastomers, hydroxy terminated polybutadiene, hydroxy terminated polyether, polyglycol adipate, glycidylazide polymer, poly bis-3,3'-azidomethyl oxetane, poly-3-nitratomethyl-3-methyl oxetane, polyethylene glycol, polypropylene glycol, cellulose acetate, and mixtures thereof.

17. The process of claim 8, wherein the strengthening agent is selected from the group consisting of azodicarbonamide, dicyandiamide, oxamide, and mixtures thereof.

18. The process of claim 8, wherein the composition is substantially smoke-free upon combustion.

* * * * *